US011013290B2

(12) United States Patent
Villanueva

(10) Patent No.: US 11,013,290 B2
(45) Date of Patent: May 25, 2021

(54) MANUFACTURING PROCESS AND DESIGN FOR A WATERPROOF BOOT

(71) Applicant: Cabela's LLC, Sidney, NE (US)

(72) Inventor: Rey Villanueva, Dongguan (CN)

(73) Assignee: Cabela's LLC, Sidney, NE (US)

( * ) Notice: Subject to any disclaimer, the term of this patent is extended or adjusted under 35 U.S.C. 154(b) by 1116 days.

(21) Appl. No.: 15/240,523

(22) Filed: Aug. 18, 2016

(65) Prior Publication Data

US 2018/0049512 A1 Feb. 22, 2018

(51) Int. Cl.

| | |
|---|---|
| ***A43B 7/12*** | (2006.01) |
| ***A43B 13/32*** | (2006.01) |
| ***A43B 3/04*** | (2006.01) |
| ***A43B 23/07*** | (2006.01) |
| ***A43B 23/02*** | (2006.01) |
| ***A43D 13/00*** | (2006.01) |
| ***A43C 11/00*** | (2006.01) |
| ***A43C 11/12*** | (2006.01) |
| ***A43C 11/14*** | (2006.01) |

(52) U.S. Cl.

CPC ..... *A43B 7/12* (2013.01); *A43B 3/04* (2013.01); *A43B 13/32* (2013.01); *A43B 23/0205* (2013.01); *A43B 23/07* (2013.01); *A43C 11/008* (2013.01); *A43C 11/12* (2013.01); *A43C 11/1493* (2013.01); *A43D 13/00* (2013.01)

(58) Field of Classification Search

CPC .... A43B 3/04; A43B 3/08; A43B 7/12; A43B 13/32; A43B 23/025; A43B 23/0255; A43B 23/045; A43D 13/00

USPC ..... 36/109, 7.1 R, 46.5, 55, 58.5

See application file for complete search history.

(56) References Cited

U.S. PATENT DOCUMENTS

| | | | | | |
|---|---|---|---|---|---|
| 1,704,688 | A * | 3/1929 | Valentine | A43B 3/16 | 36/51 |
| 2,343,477 | A * | 3/1944 | Paul | A43B 3/04 | 36/10 |
| 2,538,673 | A * | 1/1951 | Ansley | A41B 11/007 | 12/142 G |
| 3,345,763 | A * | 10/1967 | Rollman | A43B 13/32 | 12/142 R |
| 3,416,174 | A * | 12/1968 | Novitske | A43B 13/32 | 12/142 E |
| 6,035,555 | A * | 3/2000 | Pavelescu | A43B 7/125 | 36/12 |

(Continued)

*Primary Examiner* — Jila M Mohandesi

(74) *Attorney, Agent, or Firm* — Harness, Dickey & Pierce, P.L.C.

(57) ABSTRACT

A waterproof boot comprises a bootie, such as a hiking boot, and a boot upper comprising a varying diameter tube of waterproof material. The boot upper may have a bottom opening that is sealed between an outer gasket and an inner gasket affixed to the bottom of the bootie. The boot upper may also have a top opening that allows a wearer to insert a leg through the top opening of the boot upper and into the bootie. The boot upper may extend more than three inches over the top of the bootie to provide an extended waterproof shield that prevents water from entering into the top of the bootie. The boot upper may include a gusset and a zipper and/or a horizontal Velcro strip and Velcro receiving area to enlarge (or contract) the top opening of the boot upper to allow the wearer to pull the boot upper over a calf of the wearer and improve the fit and comfort of the boot upper.

18 Claims, 9 Drawing Sheets

(56) References Cited

U.S. PATENT DOCUMENTS 7,543,398 B2 * 6/2009 Hsaio ..... A43B 7/125 36/14
7,891,116 B1 * 2/2011 Iglikov ..... A43B 23/0205 36/4
8,569,190 B2 * 10/2013 Baychar ..... A43B 1/0045 442/131
2001/0037587 A1 * 11/2001 Lu ..... A43B 9/02 36/14
2003/0015822 A1 * 1/2003 Rinehart, Jr. ..... A43B 9/12 264/244
2003/0029058 A1 * 2/2003 Lin ..... A43B 7/12 36/55
2003/0131498 A1 * 7/2003 Liang ..... A43B 7/12 36/55
2004/0080077 A1 * 4/2004 Gumringer ..... A43B 3/0084 264/244
2005/0091883 A1 * 5/2005 Davis ..... A43B 7/12 36/76 R
2007/0107257 A1 * 5/2007 Laska ..... A43B 1/0027 36/4
2007/0175064 A1 * 8/2007 Culton ..... A43B 1/0081 36/7.1 R
2008/0110051 A1 * 5/2008 Min ..... A43B 7/12 36/55
2008/0313931 A1 * 12/2008 Adams ..... A41D 15/00 36/1.5
2009/0049710 A1 * 2/2009 Barnett ..... A41D 15/00 36/1.5
2009/0083996 A1 * 4/2009 Clancy ..... A43B 5/08 36/88
2010/0229429 A1 * 9/2010 Longuet ..... A43B 7/085 36/3 R
2013/0133227 A1 * 5/2013 Yu ..... A43B 23/0215 36/107
2013/0160223 A1 * 6/2013 Bier ..... A43B 3/0078 12/146 B
2014/0230271 A1 * 8/2014 Lee ..... A43B 9/02 36/12
2015/0150335 A1 * 6/2015 Healy ..... A43B 7/12 36/87
2015/0173449 A1 * 6/2015 Weitzman ..... A43B 3/0036 36/102
2015/0374063 A1 * 12/2015 Jurgeto ..... A43B 3/20 36/72 R
2016/0107417 A1 * 4/2016 Morlacchi ..... A43B 23/022 428/201
2016/0185062 A1 * 6/2016 Boucher ..... A43B 7/12 264/516
2018/0271214 A1 * 9/2018 Farris ..... D04B 21/207

* cited by examiner

MANUFACTURING PROCESS AND DESIGN FOR A WATERPROOF BOOT

FIELD OF THE INVENTION

The present invention generally relates to a waterproof boot and more specifically to a manufacturing process and design for the waterproof boot.

BACKGROUND OF THE INVENTION

The desire for waterproof boots has long been felt. Outdoors people, such as hikers and hunters, are frequently caught in the rain, have to cross through or stand in snow, pools of water and/or streams during their outdoor activities. Such activities often result in the undesirable situation of the feet of the wearer of the boots becoming wet.

Prior art methods have used waterproof materials in designing boots and this has helped to reduce the amount of water that enters the boot. However, applicants have noticed that water often still enters the boot through seams in the material of the boot or over the top of the boot. Thus, applicants desired to create a manufacturing process and a design for a waterproof boot that reduces the amount of water that enters into the boot, particularly the water that enters through the seams in the boot or over the top of the boot.

SUMMARY OF THE INVENTION

The present invention provides a manufacturing process and a design for a waterproof boot. The waterproof boot may have a bootie, which may comprise, as a non-limiting example, a hiking boot, and a boot upper which may comprise a hollow cylindrical tube of varying diameter made of waterproof material. The boot upper may have a bottom opening that during the manufacturing processes is sealed against the bottom of the bootie. In preferred embodiments, the bottom opening of the boot upper is sealed between an outer gasket and an inner gasket both affixed to the bootie. The boot upper may also have a top opening that allows a wearer to insert a leg through the boot upper and into the bootie. The boot upper may extend more than three inches and most preferably between three and eight inches over the top of the bootie. This configuration uses the top portion of the boot upper to provide an extended waterproof shield over the bootie that prevents water from entering into the top of the bootie. The boot upper may include a gusset and a zipper to enlarge (or contract) the top opening of the boot upper to allow the wearer to more easily pull the boot upper over a calf of the wearer. The boot upper may also include a horizontal Velcro strip and a Velcro receiving area near the top of the boot upper to allow the wearer to adjust the size of the top opening of the boot upper to thereby improve the fit and comfort of the boot upper around the leg of the wearer of the waterproof boot.

During the manufacturing process, a bonding agent, such as waterproof cement, may be applied along a continuous outside bottom portion of the bootie upper of the bootie and along a continuous inside bottom portion of a boot upper. The boot upper may be placed over the bootie and the outside bottom portion of the bootie upper may be attached to the inside bottom portion of the boot upper using the bonding agent. In preferred embodiments, the bonding agent that is applied to both the outside bottom portion of the bootie upper and the inside bottom portion of the boot upper is five to 50 millimeters wide and most preferably is 30 to 35 millimeters wide.

An edge of the bottom portion of the bootie upper may be stitched to an edge of the bottom portion of the boot upper. While the bootie upper and the boot upper may be attached by only using the bonding agent or by only stitching, in preferred embodiments the bootie upper and the boot upper are glued and stitched together thereby providing two attachment means of the bottom portion of the bootie upper and the bottom portion of the boot upper. In some embodiments, the bootie upper and boot upper are only fixedly or permanently connected by the bonding agent and/or the stitching. This allows an upper portion of the boot upper to be pulled up or down on the leg of the wearer independent of the movement of the bootie.

In preferred embodiments, the attaching of the bottom portion of the bootie upper and the bottom portion of the boot upper using the bonding agent and stitching is done in such a manner as to produce a staggered edge where the bottom portion of the bootie upper extends lower by two to seven millimeters and most preferably by four to five millimeters than the bottom portion of the boot upper. The staggered edge improves the lasting process.

The lasting process may produce a lasting allowance against an inner gasket fixed to the bootie using a hot base pressing pad. The lasting allowance may comprise the edge of the bottom portion of the bootie upper and the edge of the bottom portion of the boot upper. The lasting allowance is the part that is pulled under the bootie.

An outer gasket may be attached over the inner gasket using the hot base pressing pad. The outer gasket may overlap by at least five millimeters a peripheral edge of the lasting allowance, thereby sandwiching an edge of the lasting allowance between the inner gasket and the outer gasket on the bottom of the bootie.

A sole may be attached over the outer gasket, the lasting allowance, the edge of the bottom portion of the bootie upper and the edge of the bottom portion of the boot upper, thereby providing another waterproof barrier that prevents water from entering the bottom opening of the boot upper.

The above features and advantages of the present invention will be better understood from the following detailed description taken in conjunction with the accompanying drawings.

DETAILED DESCRIPTION

Figure 1:
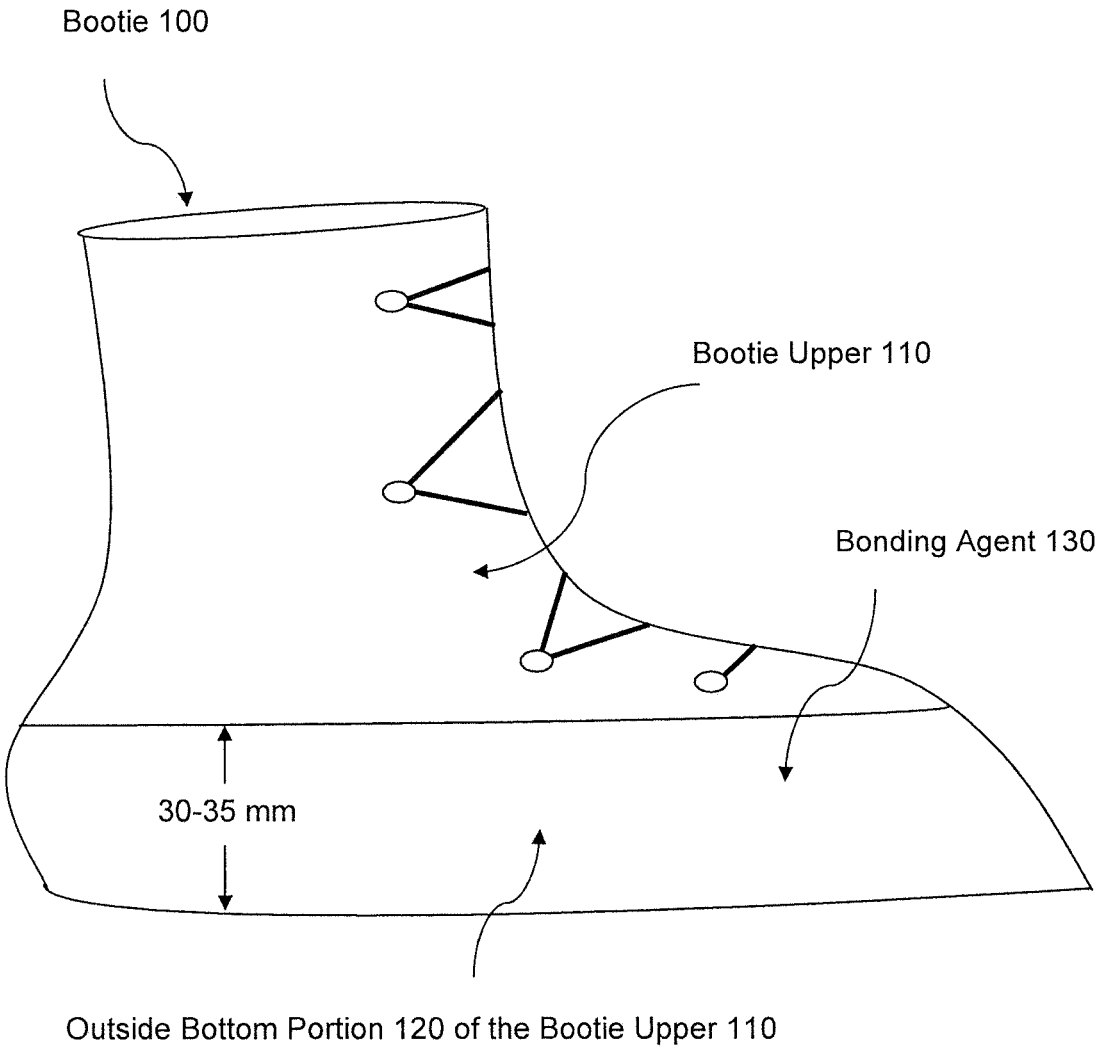
FIG. 1 is an illustration of a bootie configured to be worn by a wearer of a waterproof boot. The illustration indicates where a bonding agent may be applied to the bootie so as to be permanently attached to a boot upper illustrated in FIG. 2.

The present inventions will now be discussed in detail with regard to the attached drawing figures that were briefly described above. In the following description, numerous specific details are set forth illustrating the Applicant's best mode for practicing the invention and enabling one of ordinary skill in the art to make and use the invention. It will be obvious, however, to one skilled in the art that the present invention may be practiced without many of these specific details. In other instances, well-known machines, structures, and method steps have not been described in particular detail in order to avoid unnecessarily obscuring the present invention. Unless otherwise indicated, like parts and method steps are referred to with like reference numerals.

A waterproof boot may comprise a bootie 100. With reference to FIG. 1, the bootie 100 may have a boot structure capable of receiving a foot of the wearer of the waterproof boot. The bootie 100 may have a bootie upper 110 that extends around the foot of the wearer and preferably extends above the ankle of the wearer. As a non-limiting example, the bootie upper 110 may extend between two and seven inches above the ankle of the wearer. The bootie 100 may include padding to improve the fit and comfort of the waterproof boot. The bootie upper 110 may have a bottom portion 120 that completely encircles the bootie 100 at the lowest part of the outside of the bootie upper 110. This bottom portion 120, as a non-limiting example, is preferably 30 to 35 millimeters wide and may be attached to a boot upper 200. The outer material of the bootie 100 is preferably made of waterproof material.

Figure 2:
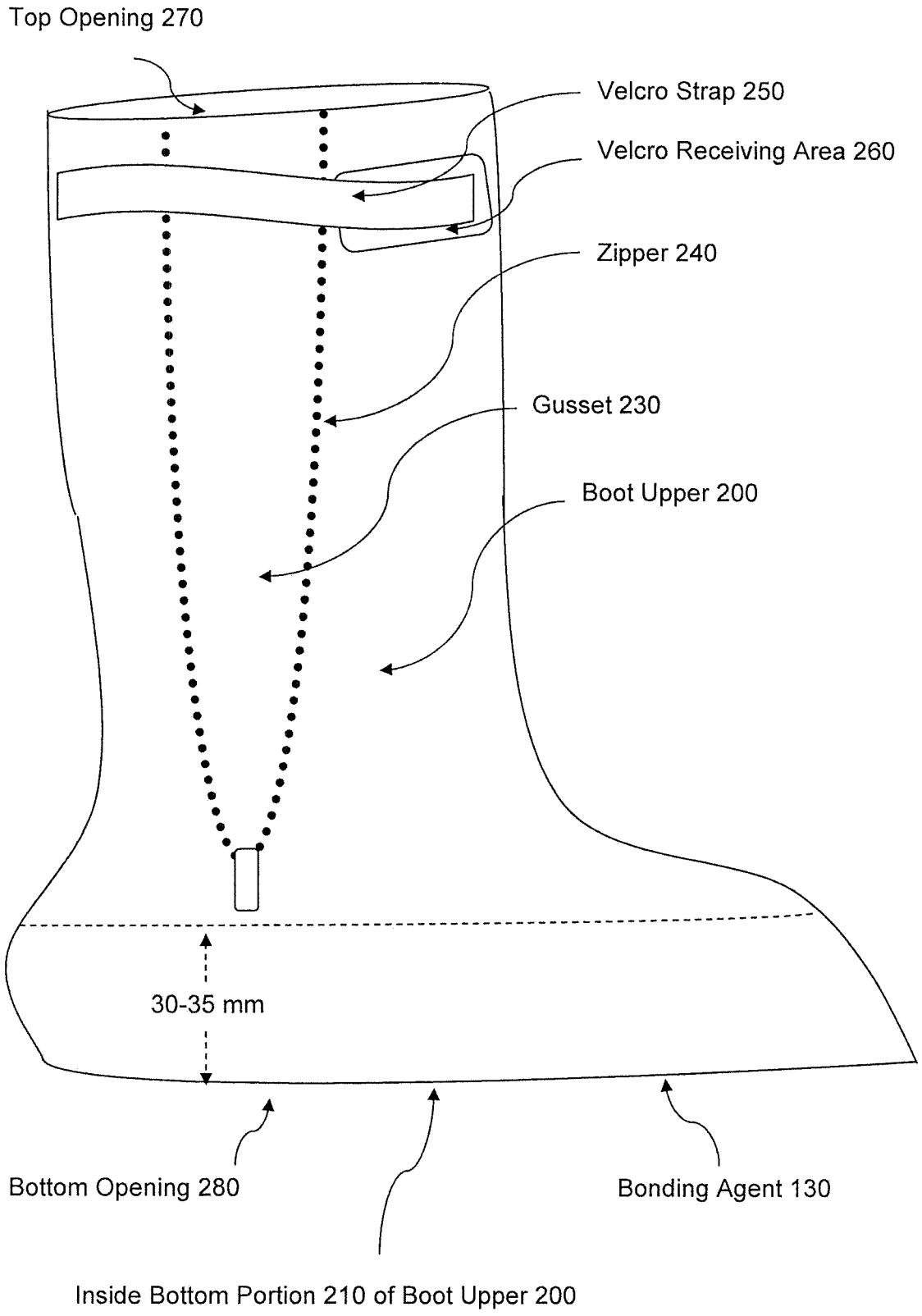
FIG. 2 is an illustration of a boot upper. This example embodiment of a boot upper comprises a Velcro strap and a Velcro receiving area and a gusset and a zipper. The illustration indicates where the bonding agent may be applied to the boot upper so as to be permanently attached to the bootie illustrated in FIG. 1.

The waterproof boot may also comprise a boot upper 200. With reference to FIG. 2, the boot upper 200 is preferably generally shaped as a hollow tube of waterproof material of varying diameter. As seen in FIG. 2, the boot upper 200 may be generally shaped like a boot. The boot upper 200 may have a top opening 270 for inserting and removing a leg of the wearer of the waterproof boot and a bottom opening 280 that is to be connected, preferably by waterproof means, to the bootie upper 110. The invention is intended to prevent water from entering the waterproof boot through the bottom opening 280 of the boot upper 200.

Figure 3:
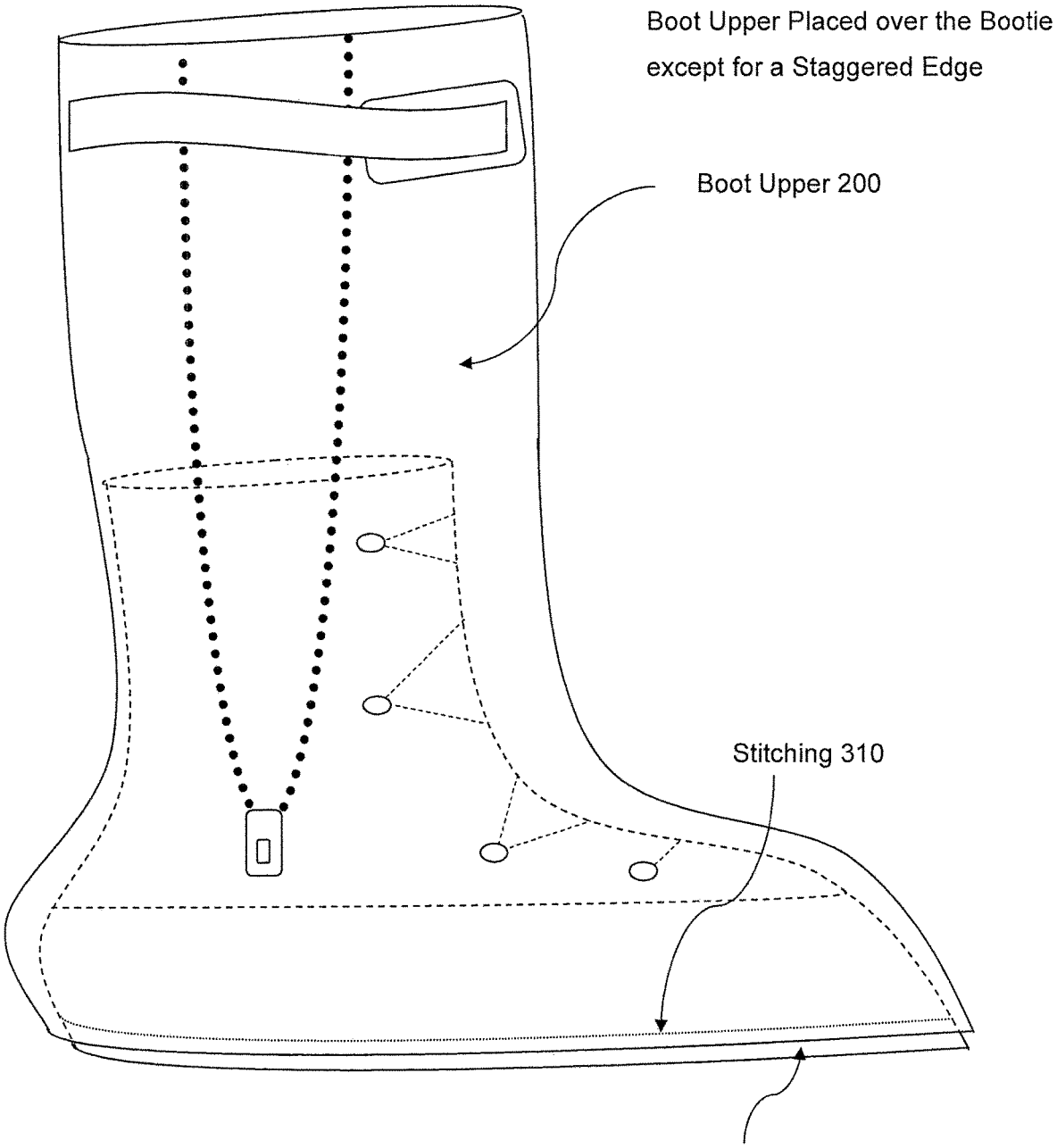
FIG. 3 is an illustration of the boot upper being placed over and surrounding the bootie. The illustration shows the preferred embodiment of a staggered edge between the outside bottom portion/edge of the bootie upper and the boot upper where the bootie extends several millimeters below the boot upper prior to the lasting process.

As illustrated in FIG. 3, the bottom opening 280 of the boot upper 200 may be configured to be attached to the bottom portion 120 of the bootie upper 110 and to extend vertically so that the top opening 270 of the boot upper 200 fits around a calf of the wearer of the waterproof boot. A lower edge or a bottom portion 210 of the inside surface of the boot upper 200 is preferably attached to a lower edge or bottom portion 120 of an outside surface of the bootie upper 110.

The lower edge or bottom portion 120 of the bootie upper 110 may be attached to the lower edge or bottom portion 210 of the boot upper 200 by any desired means. As non-limiting examples, the edge or bottom portion 120 of the bootie upper 110 may be attached to the lower edge or bottom portion 210 of the boot upper 200 using a bonding agent 130 or an adhesive, such as waterproof cement. The edge or bottom portion 120 of the bootie upper 110 may also be attached to the lower edge or bottom portion 210 of the boot upper 200 by stitching the two pieces together.

In a preferred embodiment, the lower edge or bottom portion 120 of the bootie upper 110 extends at least several millimeters lower than the lower edge or bottom portion 210 of the boot upper 200 when attached. In a preferred embodiment, the lower edge of the bootie upper 110 extends four to five millimeters below the lower edge of the boot upper 200 when attached. This staggered edge improves the lasting process.

Figure 4:
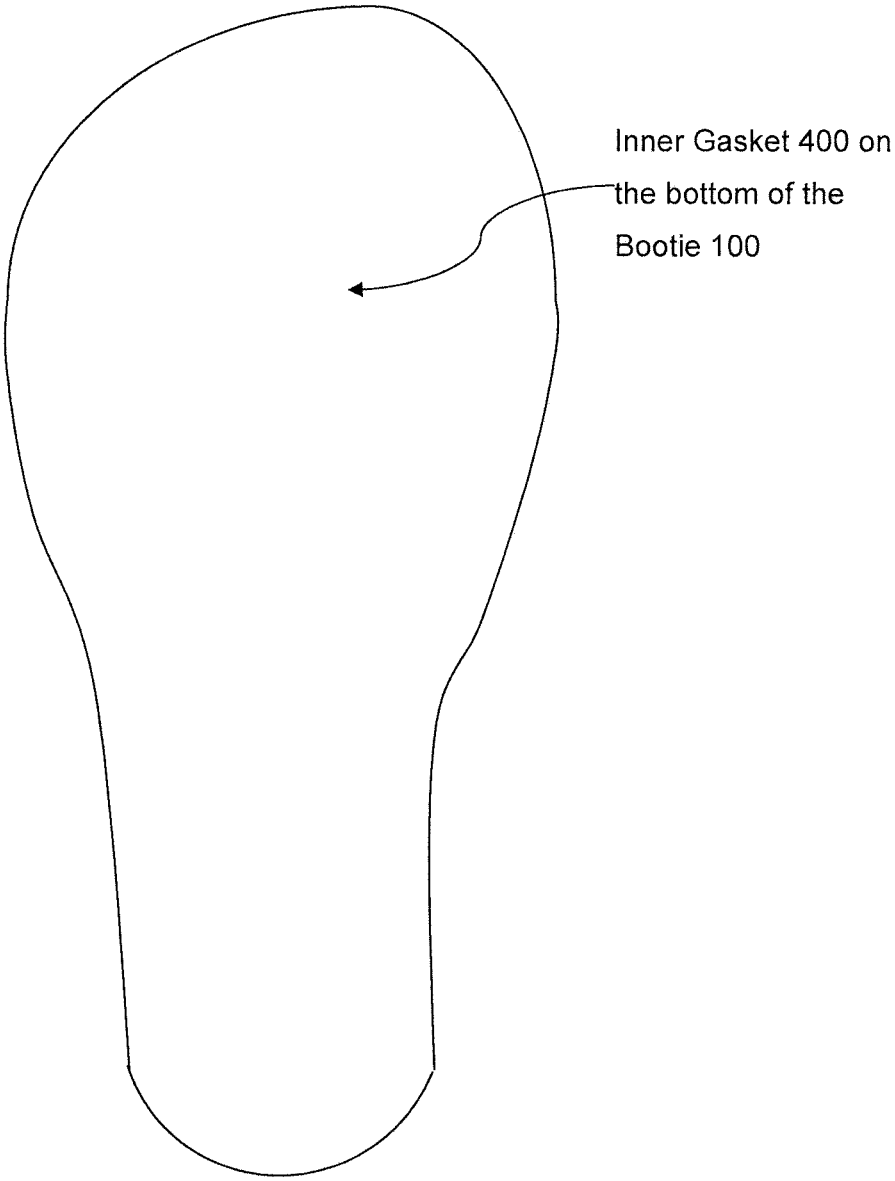
FIG. 4 is an illustration of an inner gasket attached to the bottom of the bootie.
Figure 5:
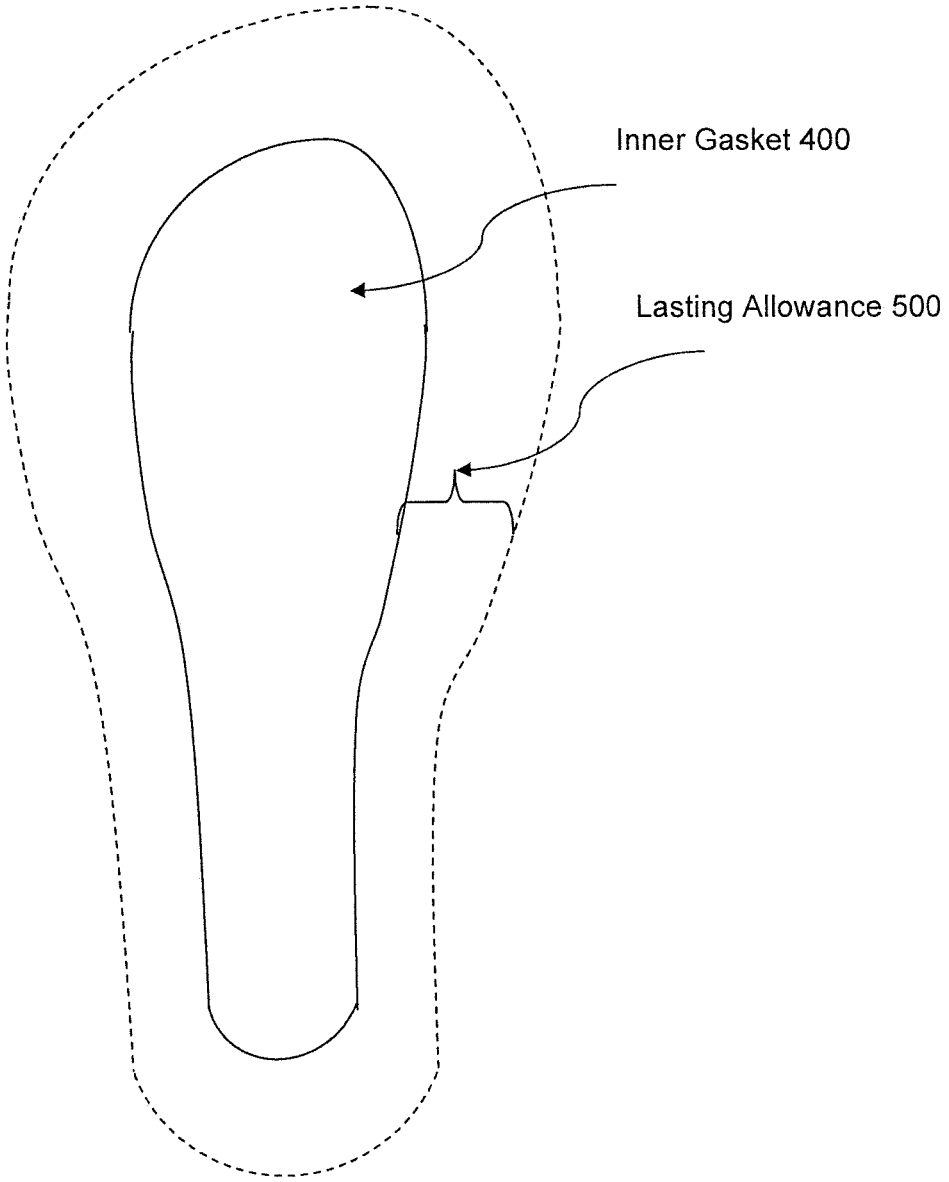
FIG. 5 is an illustration of a lasting allowance, comprising a bottom portion of the bootie upper and a bottom portion of the boot upper, pulled around the inner gasket and attached to the inner gasket during the lasting process.

An inner gasket 400 attached to the bottom of the bootie 100 is illustrated in FIG. 4. During the lasting process the edge or a part of the boot upper 200 and the edge or a lower part of the bootie upper 110 (that are attached together) may be pulled under the bootie 100 as illustrated in FIG. 5. The part of the boot upper 200 and the part of the bootie upper 110 that is pulled under the bootie 100 forms or comprises a lasting allowance 500. The lasting allowance 500 is the portion of the boot upper 200 and bootie upper 110 that is pulled, bent and/or pressed under the bootie 100 and/or against the bottom of the bootie 100 preferably during a lasting process. In other words, the lasting allowance 500 is the part of the boot upper 200 and bootie upper 110 that is pulled under and is completely on the bottom of the bootie 100.

Figure 6:
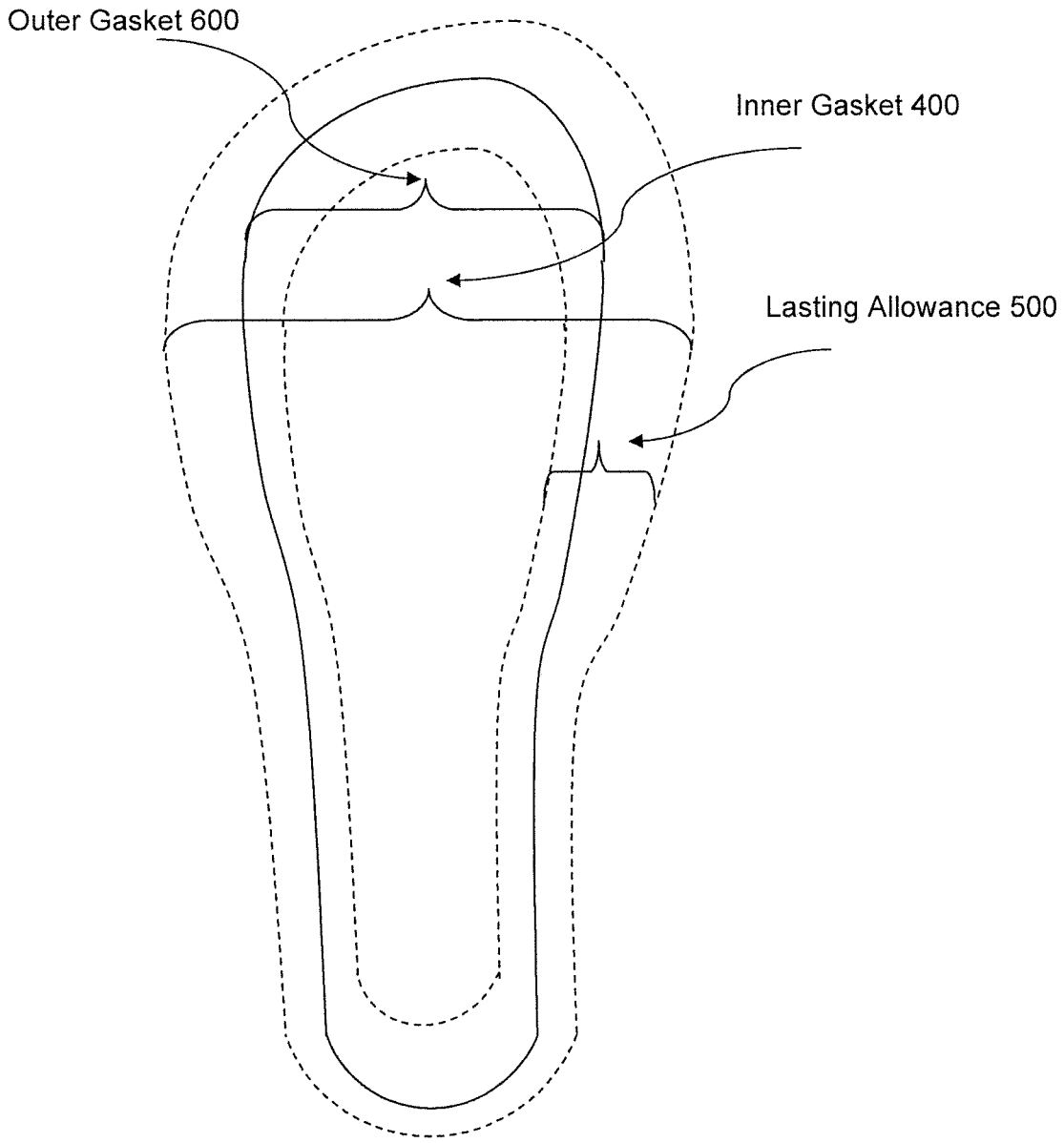
FIG. 6 is an illustration of an outer gasket being placed over part of the inner gasket and part of the lasting allowance to seal the boot upper/lasting allowance inner and between the inner gasket and the outer gasket.

This design results in the entire edge of the lasting allowance 500 comprising the edge or bottom portion of the boot upper 200 and the edge or bottom portion of the bootie upper 110 to pulled under the bootie 100 and the entire edge of the lasting allowance 500 to be sandwiched between the inner gasket 400 and an outer gasket 600 illustrated in FIG. 6, thereby reducing any leakage through a seam created by the lower part or the bottom opening 280 of the boot upper 200.

The boot upper 200 may extend vertically up the leg of the user and preferably extends at least six inches above a top of the bootie upper 110. The boot upper 200 may thus be used to prevent water from entering a top of the bootie upper 110 when water is encountered that is deeper than the height of the bootie 100.

The boot upper 200 may also comprise a waterproof gusset 230 with a vertical zipper 240. The gusset 230 may be configured to enlarge a top portion of the boot upper 200 thereby allowing a user to pull the boot upper 200 over a calf of the wearer of the waterproof boot when the vertical zipper 240 is unzipped. The gusset 230 may be configured to narrow the top portion of the boot upper 200 thereby causing the boot upper 200 to remain vertical around lightly pull against the wearer's leg when the vertical zipper 240 is zipped.

The boot upper 200 may also comprise a horizontal Velcro strap 250 and a horizontal Velcro receiving area 260 both attached near the top of the boot upper 200. The horizontal Velcro strap 250 and the horizontal Velcro receiving area 260 may be configured to narrow the top portion of the boot upper 200 above the calf of the wearer of the waterproof boot when the Velcro strap 250 is connected to the Velcro receiving area 260. The wearer of the waterproof boot may use the horizontal Velcro strap 250 and the horizontal Velcro receiving area 260 to narrow the top of the boot upper 200 around the leg of the user so that the boot upper 200 remains vertically around the leg of the wearer and prevents the boot upper 200 from sliding down the leg of the wearer during use.

The horizontal Velcro strap 250 and horizontal Velcro receiving area 260 may also be disconnected thereby enlarging the top portion of the boot upper 200. An enlarged top portion of the boot upper 200 allows the user to either pull the boot upper 200 over the calf of the wearer of the waterproof boot when putting the waterproof boot on or allows the user to pull the boot upper 200 down over the calf of the wearer of the waterproof boot when removing the waterproof boot.

An inner gasket 400 may be attached to the bottom of the bootie 100. A padded insole may be added over the inner gasket 400 to improve fit and comfort for the wearer of the waterproof boots. The inner gasket 400 may be generally shaped like a slightly smaller version of the sole of the waterproof boot. During the lasting process, the lasting allowance 500 may extend over the edge and be attached to the inner gasket 400. In preferred embodiments, the lasting allowance 500 extends over the edge of the inner gasket 400 by at least ten millimeters. The lasting allowance 500 may comprise an edge of the bottom portion 120 of the bootie upper 110 and an edge of the bottom portion 210 of the boot upper 200. The lasting allowance 500 preferably completely covers a peripheral edge of the inner gasket 400 by at least 10 millimeters and thus has the lasting allowance 500 has a width of at least 10 millimeters.

An outer gasket 600 may also be generally shaped like a slightly smaller version of the sole of the waterproof boot. The outer gasket 600 may be attached to a part of the inner gasket 400 and preferably overlaps all of the edge of the lasting allowance 500. As a non-limiting example, the outer gasket 600 may overlap the entire peripheral edge of the lasting allowance 500 by at least six millimeters and most preferably by eight to 10 millimeters. In other words the entire peripheral edge of the lasting allowance 500 may be sandwiched or trapped between the inner gasket 400 and the outer gasket 600 to prevent water from entering the boot through a bottom opening 280 of the boot upper 200. The bottom opening 280 of the boot upper 200 is completely sealed between the inner gasket 400 and the outer gasket 600.

A waterproof sole may be attached to the bottom of the bootie 100 completely covering the outer gasket 600, the lasting allowance 500 and the inner gasket 400. This configuration provides another waterproof barrier to prevent water from entering the waterproof boot through the bottom opening 280 of the boot upper 200.

In a preferred embodiment, a lower portion 210, including the bottom opening 280, of the boot upper 200 is sealed in a waterproof manner and permanently attached to the bootie 100. The remainder of the boot upper 200 forms an outer water barrier for the bootie 100, but the remainder of the boot upper 200, while they may be touching, is not attached, permanently or otherwise, to the bootie 100. This allows the boot upper 200 to be easily adjusted by sliding the boot upper 200 up and down the leg of the wearer of the waterproof boot independent of the bootie 100.

A process for manufacturing the above described waterproof boot will now be described. A bonding agent 130 may be applied along a continuous outside bottom portion 120 of a bootie upper 110. The width of the bootie upper 110 with the bonding agent 130 may be any desired width, but as a non-limiting example, may be between 30 to 35 millimeters.

The bonding agent 130 may also be applied along a continuous inside bottom portion 210 of a boot upper 200. The width of the boot upper 200 with the bonding agent 130 may be any desire width, but is preferably about the same width of bonding agent 130 used on the bootie upper 110. As an example, if the width of the bonding agent 130 on the bootie upper 110 is 35 millimeters then the preferred width of the bonding agent 130 on the boot upper 200 is also 35 millimeters. The bonding agent 130 applied to the bootie upper 110 and the boot upper 200 may comprise any desired adhesive, but is preferably, as a non-limiting example, waterproof cement.

A waterproof gusset 230 with a vertical zipper 240 may be attached to the boot upper 200. The gusset 230 and vertical zipper 240 may be configured to enlarge the top portion or the top opening 270 of the boot upper 200 when the vertical zipper 240 is unzipped and to narrow the top opening 270 or top portion of the boot upper 200 when the vertical zipper 240 is zipped. An enlarged top opening 270 makes it easier for the wearer to pull the boot upper 200 over the calf of the wearer when putting the waterproof boot on the leg of the wearer. A narrower top opening 270 assists in holding the boot upper 200 to the leg over the calf of the wearer thereby making it less likely the boot upper 200 will slide down the leg of the wearer allowing water to enter over and into the top opening 270 of the boot upper 200.

A horizontal Velcro strap 250 and a horizontal Velcro receiving area 260 may be attached to the boot upper 200. The horizontal Velcro strap 250 and Velcro receiving area 260 may be configured to narrow the top portion of the boot upper 200 above the calf of the wearer of the waterproof boot. The horizontal Velcro strap 250 and the horizontal Velcro receiving area 260 may be configured to allow the wearer to adjust the diameter of the top opening 270 of the boot upper 200 to improve the fit and comfort of the boot upper 200 around the leg of the wearer of the waterproof boot.

The outside bottom portion 120 of the bootie upper 110 may be attached to the inside bottom portion 210 of the boot upper 200 using the bonding agent 130. In a preferred embodiment, the bottom portion 120 of the bootie upper 110 extends below the bottom portion 210 of the boot upper 200 by at least two millimeters and most preferably by between four and five millimeters. This staggered edge of the bottom portion 120 of the bootie upper 110 and the bottom portion 210 of the boot upper 200 may improve the lasting process.

An edge of the bottom portion 120 of the bootie upper 110 may be stitched to an edge of the bottom portion 210 of the boot upper 200. In preferred embodiments, the stitching is done to retain a staggered edge of the bottom portion 120 of the bootie upper 110 extending lower or beyond the bottom portion 210 of the boot upper 200 by more than two millimeters and preferably between four and five millimeters.

A lasting process may be performed or executed to flatten a lasting allowance 500 against an inner gasket 400 attached or fixed to the bootie 100. In preferred embodiments, a hot base pressing pad may be used to execute the lasting process. The lasting allowance 500 comprises the edge and a part of the bottom portion 120 of the bootie upper 110 and the edge and a part of the bottom portion 210 of the boot upper 200. Thus, at this point the bottom opening 280 or the bottom portion 210 of the boot upper 200 is flattened against an inner gasket 400 on the bottom of the bootie 100.

An outer gasket 600 may be attached over the inner gasket 400. In preferred embodiments, a hot base pressing pad may be used. The outer gasket 600 may overlap by at least five millimeters, and most preferably by eight to 10 millimeters, all of a peripheral edge of the lasting allowance 500 comprising the edge and a part of the bottom portion 120 of the bootie upper 110 and the edge and a part of the bottom portion 210 of the boot upper 200. This process preferably results in the lower edge, i.e., bottom opening 280, of the boot upper 200 being sandwiched between the inner gasket 400 and the outer gasket 600.

Figure 7:
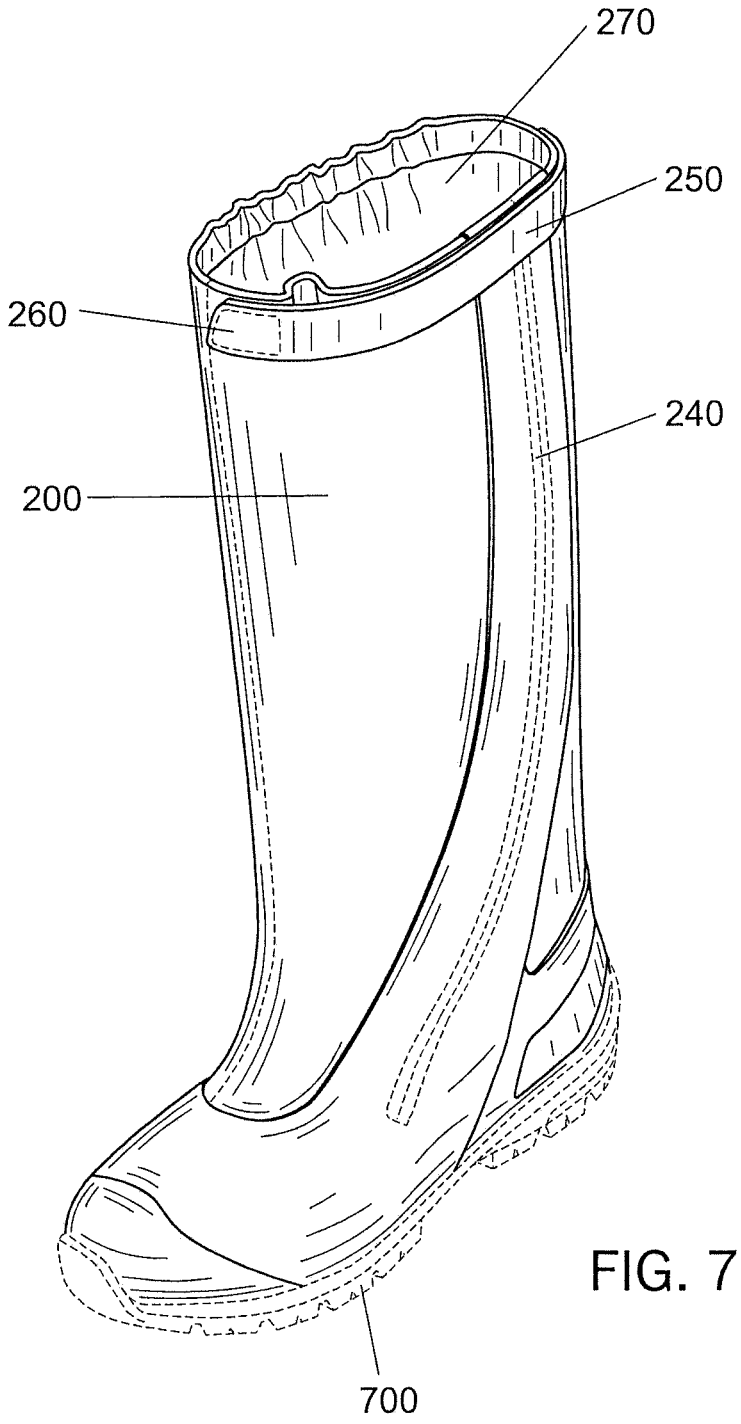
FIGS. 7-9 are illustrations of one possible embodiment of a completed waterproof boot from different perspectives according to the present invention.
Figure 8:
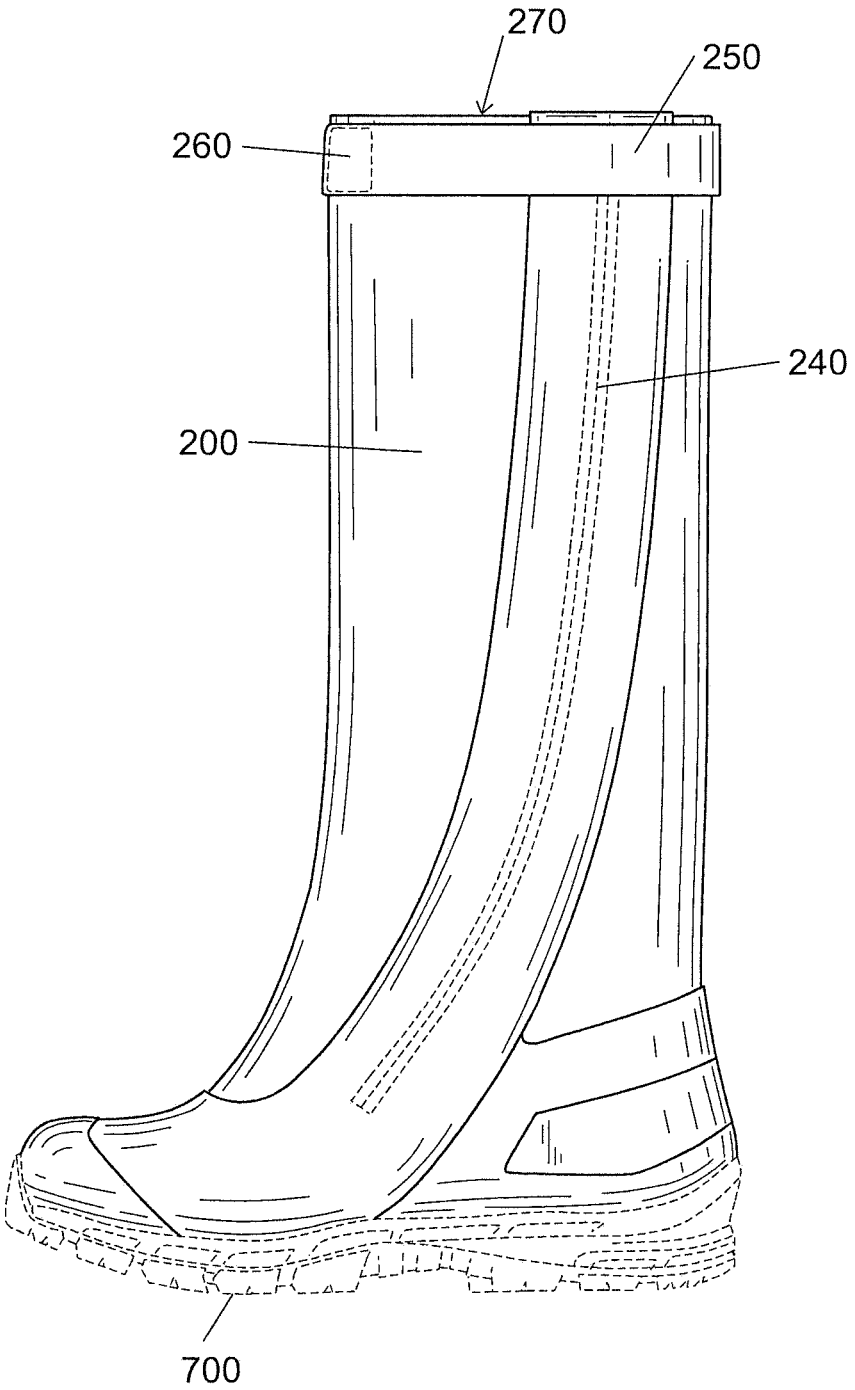
Figure 9:
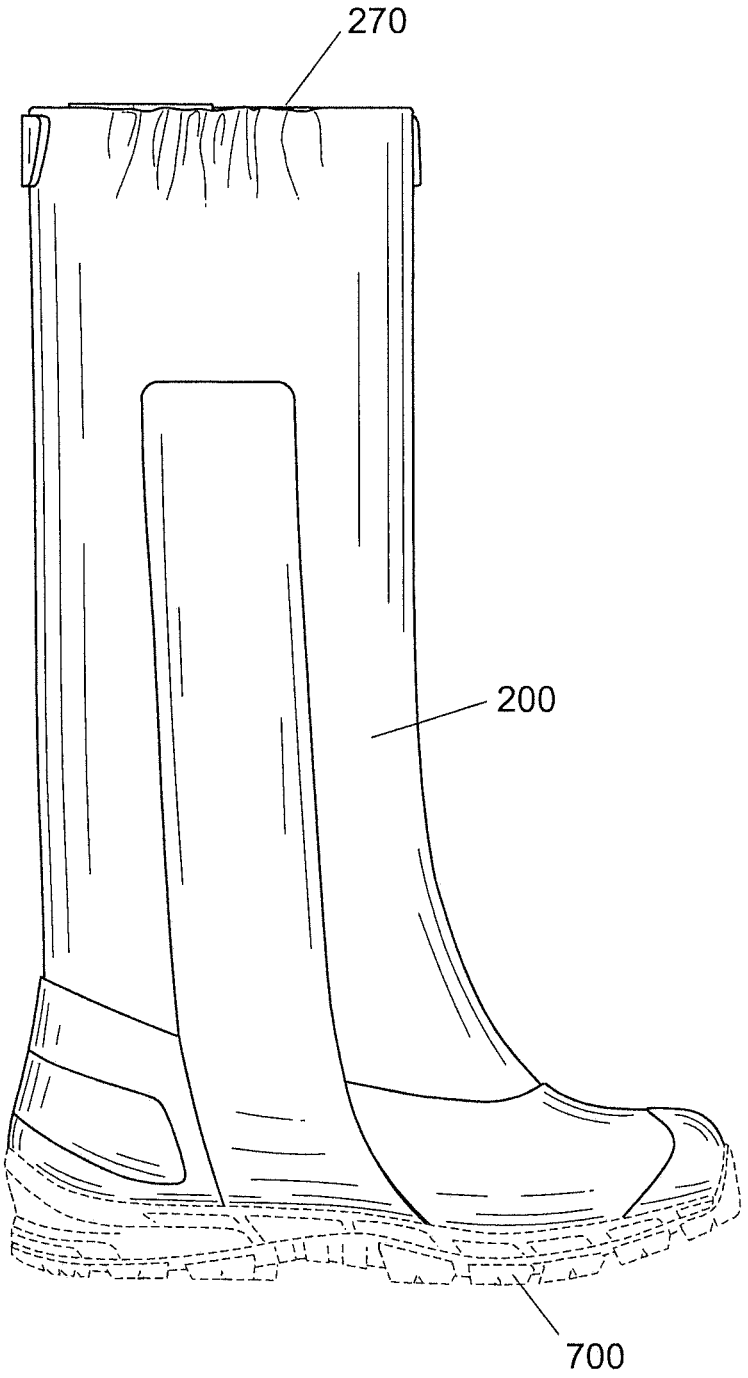

FIGS. 7-9 illustrate various perspectives of an example embodiment of a completed waterproof boot according to the present invention. As illustrated in FIGS. 7-9, a waterproof sole 700 may be attached over the outer gasket 600, the lasting allowance 500, and the inner gasket 400 providing another waterproof barrier using any known or later developed desired method.

Other embodiments and uses of the above inventions will be apparent to those having ordinary skill in the art upon consideration of the specification and practice of the invention disclosed herein. It should be understood that features listed and described in one embodiment may be used in other embodiments unless specifically stated otherwise. The specification and examples given should be considered exemplary only, and it is contemplated that the appended claims will cover any other such embodiments or modifications as fall within the true scope of the invention.

The invention claimed is:

1. A manufacturing process for a waterproof boot, comprising the steps of:

applying a bonding agent along a continuous outside surface of a bottom portion of a bootie upper of a bootie, wherein the bootie comprises a boot structure and is configured to extend and fit around at least a portion of a foot of a user of the waterproof boot;

applying the bonding agent along a continuous inside surface of a bottom portion of a boot upper, wherein the boot upper comprises a hollow tube of waterproof material of varying diameters;

attaching the outside surface of the bottom portion of the bootie upper to the inside surface of the bottom portion of the boot upper using the bonding agent;

stitching together an edge of the bottom portion of the bootie upper to an edge of the bottom portion of the boot upper;

flattening a lasting allowance against an inner gasket fixed to a bottom of the bootie using a hot base pressing pad, wherein the lasting allowance comprises the edge of the bottom portion of the bootie upper and the edge of the bottom portion of the boot upper that is pulled under the bootie;

attaching an outer gasket over the inner gasket using a hot base pressing pad, wherein the outer gasket overlaps by at least five millimeters a peripheral edge of the lasting allowance thereby sandwiching the edge of the lasting allowance between the inner gasket and the outer gasket; and attaching a sole over the outer gasket and the lasting allowance including the edge of the bottom portion of the bootie upper and the edge of the bottom portion of the boot upper.

2. The manufacturing process of claim 1, wherein the bonding agent comprises a waterproof cement.

3. The manufacturing process of claim 1, wherein the boot upper is configured to fit around a calf of the user of the waterproof boot.

4. The manufacturing process of claim 1, wherein a top of the boot upper extends at least six inches above a top of the bootie upper.

5. The manufacturing process of claim 1, wherein the outer gasket overlaps the peripheral edge of the lasting allowance by 8 to 10 millimeters.

6. The manufacturing process of claim 1, wherein the boot upper further comprises:

a waterproof gusset with a vertical zipper configured to enlarge a top portion of the boot upper and allow the user to pull the boot upper over a calf of the user of the waterproof boot when the vertical zipper is unzipped and to narrow the top portion of the boot upper when the vertical zipper is zipped; and a horizontal hook and loop fastener strap and a horizontal hook and loop fastener receiving area attached to the boot upper configured to narrow the top portion of the boot upper above the calf of the user of the waterproof boot.

7. The manufacturing process of claim 1, wherein the attaching the outside surface of the bottom portion of the bootie upper to the inside surface of the bottom portion of the boot upper using the bonding agent and the stitching together the edge of the bottom portion of the bootie upper to the edge of the bottom portion of the boot upper result in a staggered edge configuration in which the edge of the bottom portion of the bootie upper extends four to five millimeters past the edge of the bottom portion of the boot upper before flattening the lasting allowance.

8. The manufacturing process of claim 1, wherein the bonding agent is applied over a 30 to 35 millimeters wide bottom portion of the bootie upper and a 30 to 35 millimeters wide bottom portion of the boot upper.

9. The manufacturing process of claim 1, wherein the bootie extends above an ankle of the user.

10. The manufacturing process of claim 9, wherein the bootie extends between 2 and 7 inches above the ankle of the user.

11. The manufacturing process of claim 1, further comprising an insole added over the inner gasket on a side that is opposite to the side on which the lasting allowance is flattened against the inner gasket.

12. A manufacturing process for a waterproof boot, comprising the steps of:

applying a bonding agent along a continuous outside surface of a bottom portion of a bootie upper of a bootie, wherein the bootie comprises a boot structure and configured to extend and fit around at least a portion of a foot of a user;

applying the bonding agent along a continuous inside surface of a bottom portion of a boot upper, wherein the boot upper comprises a hollow tube of waterproof material of varying diameters configured to fit around a calf of the user of the waterproof boot;

attaching the outside surface of the bottom portion of the bootie upper to the inside surface of the bottom portion of the boot upper using the bonding agent;

stitching together an edge of the bottom portion of the bootie upper to an edge of the bottom portion of the boot upper;

executing a lasting process to flatten a lasting allowance against an inner gasket fixed to a bottom of the bootie, wherein the lasting allowance comprises the edge of the bottom portion of the bootie upper and the edge of the bottom portion of the boot upper pulled under the bootie;

attaching an outer gasket over the inner gasket using a hot base pressing pad, wherein the outer gasket overlaps by at least five millimeters a peripheral edge of the lasting allowance thereby sandwiching the edge of the lasting allowance between the inner gasket and the outer gasket; and attaching a sole over the outer gasket and the lasting allowance including the edge of the bottom portion of the bootie upper and the edge of the bottom portion of the boot upper.

13. The manufacturing process of claim 12, wherein the bonding agent comprises a waterproof cement.

14. The manufacturing process of claim 12, wherein a top of the boot upper extends at least six inches above a top of the bootie upper.

15. The manufacturing process of claim 12, wherein the outer gasket overlaps the peripheral edge of the lasting allowance by 8 to 10 millimeters.

16. The manufacturing process of claim 12, wherein the boot upper further comprises:

a waterproof gusset with a vertical zipper configured to enlarge a top portion of the boot upper and allow a user to pull the boot upper over the calf of the userwe-areF of the waterproof boot when the vertical zipper is unzipped and to narrow the top portion of the boot upper when the vertical zipper is zipped; and a horizontal hook and loop fastener strap and a horizontal hook and loop fastener receiving area attached to the boot upper configured to narrow the top portion of the boot upper above the calf of the user of the waterproof boot when the hook and loop fastener strap is connected to the hook and loop fastener receiving area.

17. The manufacturing process of claim 12, wherein the steps of attaching the outside surface of the bottom portion of the bootie upper to the inside surface of the bottom portion of the boot upper using the bonding agent and stitching together the edge of the bottom portion of the bootie upper to the edge of the bottom portion of the boot upper are performed to result in a staggered edge configuration in which the edge of the bottom portion of the bootie upper extends four to five millimeters past the edge of the bottom portion of the boot upper before flattening the lasting allowance.

18. The manufacturing process of claim 12, wherein the bonding agent is applied over a 30 to 35 millimeters wide bottom portion of the bootie upper and a 30 to 35 millimeters wide bottom portion of the boot upper.

* * * * *